United States Patent [19]

Zens

[11] 4,110,934

[45] Sep. 5, 1978

[54] HINGE MECHANISM FOR A SLIDING DOOR

[75] Inventor: John F. Zens, Algonac, Mich.

[73] Assignee: General Motors Corporation, Detroit, Mich.

[21] Appl. No.: 855,169

[22] Filed: Nov. 28, 1977

[51] Int. Cl.[2] ..... E05D 15/10

[52] U.S. Cl. ..... 49/218; 49/223; 296/155

[58] Field of Search ..... 49/209, 211, 213, 214, 49/215, 216, 218, 221, 223; 296/155

[56] References Cited

U.S. PATENT DOCUMENTS

| | | | |
|---|---|---|---|
| 3,100,667 | 8/1963 | Schwenk | 49/214 |
| 3,204,999 | 9/1965 | Schwenk | 49/213 |
| 3,935,674 | 2/1976 | Williams et al. | 49/216 |

*Primary Examiner*—Philip C. Kannan
*Attorney, Agent, or Firm*—K. H. MacLean, Jr.

[57] ABSTRACT

A hinge and latch mechanism to guide one edge of a vehicle sliding door for initially moving the edge laterally away from a vehicle body during opening and subsequently guiding movement of the edge in a longitudinal direction along the vehicle body. A generally U-shaped link member is utilized to support the one edge, a leg of which is operably connected to the door while a second leg is operably connected to the vehicle body. The body-oriented leg has a cam member attached thereto interactive with a door latching arm to prevent longitudinal movement of the latch mechanism during initial pivoting movement of the door to a laterally outward position and to permit subsequent longitudinal movement after the initial lateral movement.

2 Claims, 7 Drawing Figures

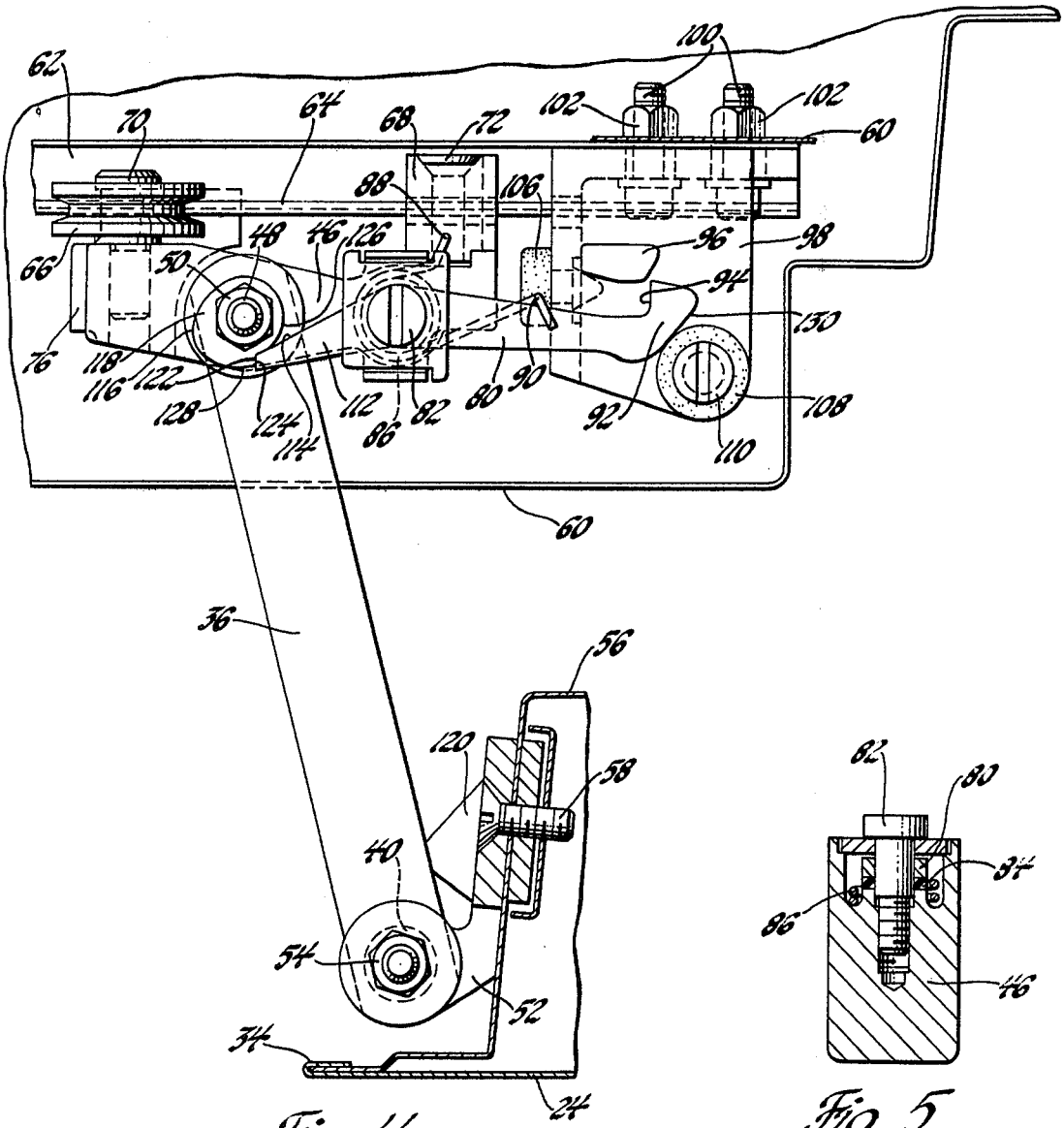
Fig. 4
Fig. 5
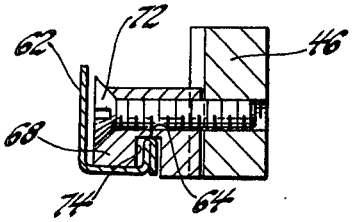
Fig. 6
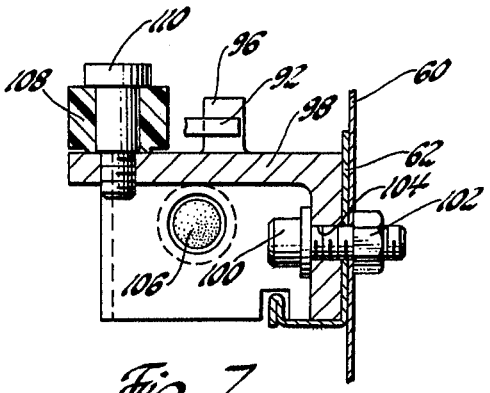
Fig. 7

HINGE MECHANISM FOR A SLIDING DOOR

A vehicle sliding door is disclosed in U.S. Pat. No. 3,100,667 to Schwenk which is appraised to be the closest prior art. The subject sliding door is similar in some respects to the Schwenk device and both are supported at the forward edge by roller and track means and at the rearward edge by a laterally pivotal and longitudinally moving hinge mechanism. In the Schwenk patent, the mechanism utilizes two lever arms to produce a latching function. These lever arms are sequentially engaged, first with a portion of the body to maintain the hinge mechanism stationary during the initial lateral movement of the door edge and, secondly, with the hinge mechanism to hold it in a predetermined laterally oriented position during subsequent sliding movement of the door along the vehicle body.

The subject hinge and latch mechanism eliminates the need for dual lever arms as shown in the Schwenk patent. Instead, means are provided for greatly simplifying the mechanism to initially hold the hinge mechanism stationary and subsequently permitting it to slide along the vehicle body as the door edge moves correspondingly.

The subject improved hinge and latch mechanism utilizes a cam member attached to one leg of a link member connected adjacent the door edge of the vehicle body. As the link member pivots from a fore and aft orientation to a laterally outward orientation, the cam member moves a latching lever which holds the hinge mechanism in the stationary position with respect to the vehicle. After the link member is in its laterally outward position, the end of the latch lever engages an offset portion of the cam to hold the link member in its laterally outward position. This permits a carriage to which the link member is attached to begin rearward sliding movement with respect to the vehicle body to thus complete opening of the sliding door.

The several advantages and features of the subject hinge and latch mechanism will be more readily apparent after a reading of the following detailed description, reference being had to the drawings in which a preferred embodiment is illustrated.

In the drawings:

FIG. 4 is a view similar to FIG. 2 but with the door and the mechanism in a second operative position;

FIG. 5 is a fragmentary sectional view of the mechanism taken along sectional line 5—5 in FIG. 3 and looking in the direction of the arrows;

FIG. 6 is a fragmentary sectional view taken along section line 6—6 in FIG. 3 and looking in the direction of the arrows; and FIG. 7 is a fragmentary sectional view taken along section line 7—7 in FIG. 3 and looking in the direction of the arrows.

Figure 1:
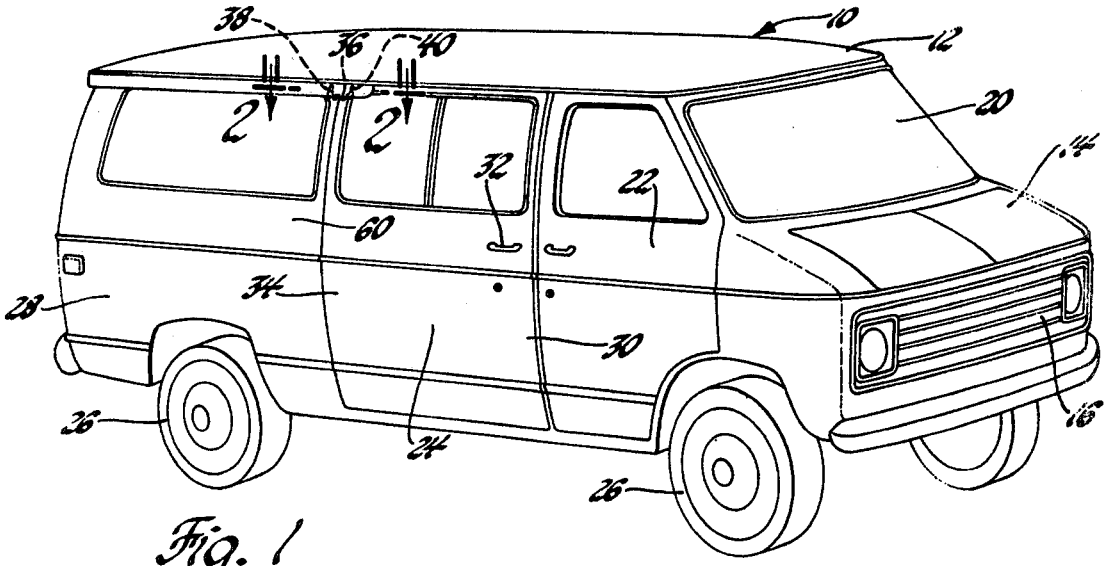
FIG. 1 is a perspective view of a van-type vehicle having a sliding door including the subject latch and hinge mechanism.

In FIG. 1, a van-type vehicle 10 is illustrated. The vehicle 10 includes a body with a roof portion 12, a hood 14, a grill 16, a windshield 20, a vertically hinged door 22 and a rearward sliding-type door 24. The vehicle, of course, has wheels 26 and a rear body portion 28.

Figure 2:
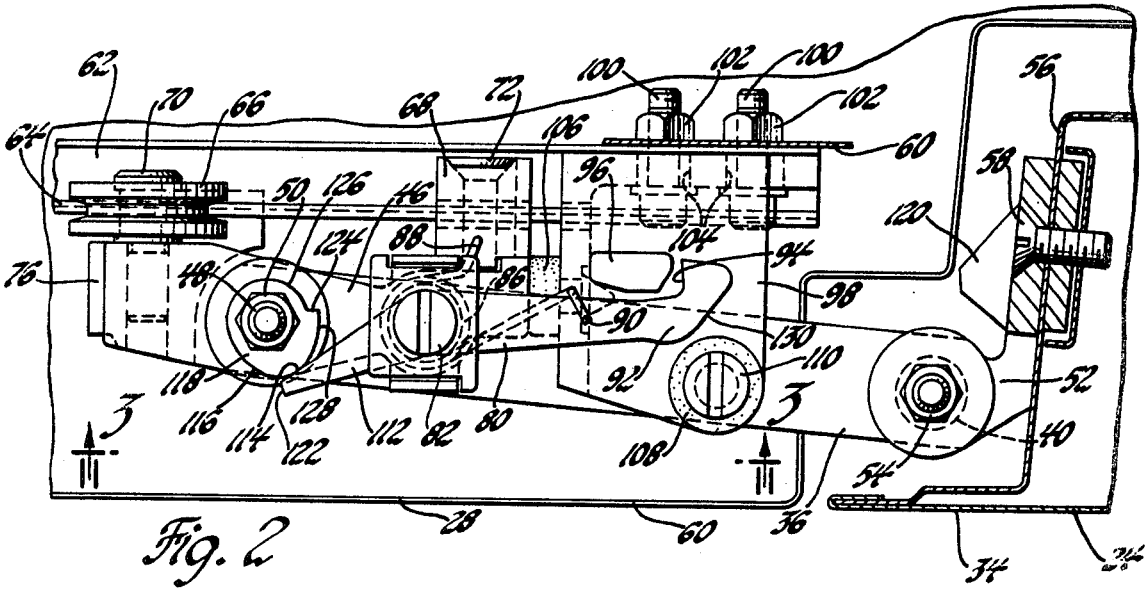
FIG. 2 is a sectional view of the hinge and latch mechanism taken along sectional line 2—2 in FIG. 1 and looking in the direction of the arrows.
Figure 3:
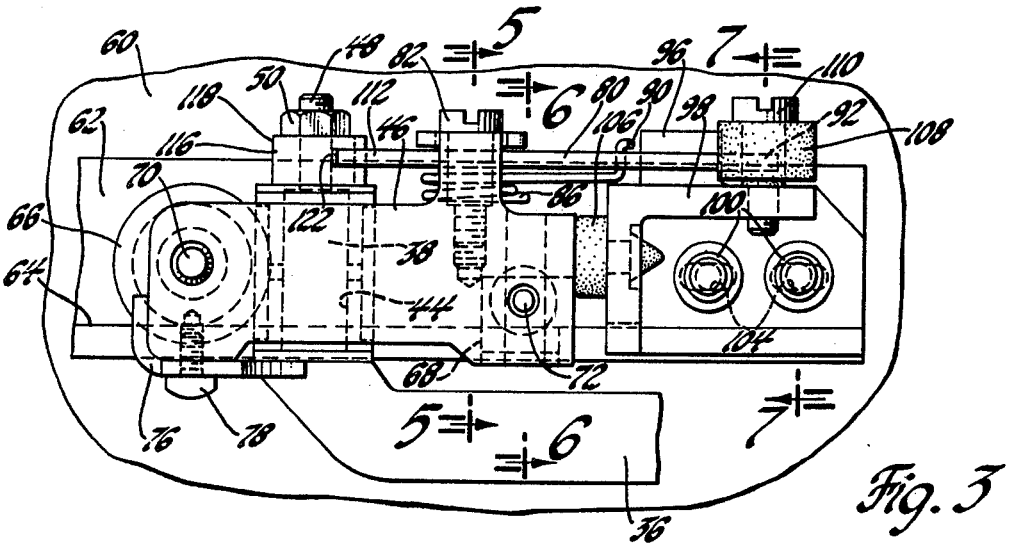
FIG. 3 is a view taken along view line 3—3 in FIG. 2.

The sliding-type door 24 is supported at its forward edge portion 30 in a fairly conventional manner as disclosed in the Schwenk patent. Specifically, portion 30 is supported at both its upper and lower locations by rollers engageable with tracks on the vehicle body. This smoothly guides the portion 30 laterally outward and rearward when the door is opened by manual operation of the handle portion 32. The hinge and latch mechanism utilizes a U-shaped link member 36 to support the edge 34 of door 24. It has an upstanding leg portion 38 operably connected to the vehicle body and another leg portion 40 attached to the sliding door 24. As best shown in FIGS. 2 and 3, the leg portion 38 of link 36 extends upward through an opening 44 in a carriage member 46. The upper end of leg 38 is threaded at 48 to receive a nut-type fastener 50 which secures the link member 36 to the member 46. The other leg portion 40 extends through an opening in hinge bracket 52 as shown in FIG. 2. A nut fastener 54 engages a threaded upper end of leg portion 40 to secure the link member 36 to bracket 52. The bracket 52, in turn, is attached to an inner panel 56 of the door 24 by threaded cap screw fasteners 58.

The link member 36 is free to pivot in a clockwise direction about leg portion 38 to the lateral outward position shown in FIG. 4 as the door edge 28 moves correspondingly laterally outward in its initial opening movement. Both leg portions 38, 40 are free to pivot respectively within the carriage 46 and bracket 52. During pivotal movement of the link member 36 to the lateral position, the carriage 46 remains in a stationary position with respect to the vehicle body 60. A track member 62 supports the carriage 46 with respect to body 60 and includes an upstanding edge portion 64 running in a longitudinal direction with respect to the vehicle and rearward from the door edge portion 34. Rollers 66 support the rearward end of carriage 46 on the upstanding edge portion 64 of track 62 and slider block member 68 supports the forward end. The roller 66 is attached to the carriage by a fastener 70 threaded into the carriage body. The slider block 68 as best shown in FIG. 6 is attached to the carriage body 46 by a screw fastener 72. As seen in FIG. 6, a channel 74 is formed in the slider block 68 and sits around the upstanding edge portion 64 of track 62. The carriage 46 may move rearward with respect to the vehicle along track 62 and the roller 66 is maintained in contact with the edge 64 of track 62 by action of a finger member 76 attached to the carriage 46 by fastener 78. Member 76 includes a portion extending beneath the track 62.

The carriage 46 remains stationary with respect to track 62 during the initial pivoting movement of link member 36 between the closed position shown in FIG. 2 and the partially open position shown in FIG. 4. An operative latch lever 80 is pivotally attached to the carriage 46 at its midportion by a fastener member 82 and is snugly abutted against the top of the carriage 46 but free to pivot about the axis of fastener 82. As shown in FIG. 5, a washer-shaped member 84 is situated beneath the arm or latch lever 80 to provide smooth pivotal movement of the lever 80 thereon. A coil spring 86 is disclosed with a midportion encircling the fastener 82 and an end 88 fixed to the carriage 46. The other end 90 of the spring 86 bears against the lever 80 to urge the lever from a latch position in FIG. 2 to the release position shown in FIG. 4. One end 92 of lever 80 has a hooked configuration which includes a latching surface 94 movable into engagement with a stationary striker member 96. The engagement between surface 94 and striker 96 prevents a carriage 46 from moving rearward on the track 62 during the initial door-opening movement.

Striker 96 is best shown in FIG. 7 and extends from a bracket member 98 which is fastened to the track 62 and the vehicle body 60 by bolt and nut fasteners 100, 102, respectively. The bracket itself has elongated openings 104 therethrough which permits the bracket 98 to be adjustably mounted fore and aft on the track 62. Also attached to bracket 98 is an elastomeric bumper member 106 for engagement with the carriage 46 as shown in FIG. 3. This cushions the impact between the carriage 46 and and bracket 98. Bracket 98 also supports an elastomeric roller guide 108 which is secured to the bracket by a fastener 110. The function of the roller guide 108 will be described more particularly hereinafter.

A second end portion 112 of the latching lever 80 extends away from the fastener 82 in an opposite direction than first end 92. As shown in FIG. 2, the second end portion 112 has a surface 114 thereon which engages surface 116 of a cam member 118. Cam member 118 has a central opening through which the threaded portion 48 of leg 38 extends. The nut 50 secures the cam member 118 to the leg portion for rotation together. The surface 116 is characterized by a variable dimension between an axis of rotation and the point of contact with surface 114. As the link member 36 rotates from the closed position in FIG. 2 to the partially open position in FIG. 4, the center-to-surface dimension decreases to permit the spring 86 to rotate the latch lever 80 clockwise in FIG. 2. When the lever 80 rotates to the position shown in FIG. 4, the surface 94 is free of striker 96 and the carriage 46 may move along track 62 to the left in FIG. 4. Thus, the door 24 is controlled to initially move laterally and rearwardly to the position shown in FIG. 4 and then to move longitudinally with respect to the vehicle along the body 60.

To maintain the link member 36 in the laterally oriented position shown in FIG. 4, a projecting stop 120 is carried by the hinge bracket member 52. This stop prevents further clockwise rotation of the link member 36 with respect to the bracket 52. For the purpose of preventing counterclockwise rotation of the link member 36 with respect to the hinge 52 on the carriage 46, the end 112 of latch lever 80 is configured to have an end surface 122 which engages an abrupt shoulder portion 124 of the cam member 118 when the link member 36 is in the partially open position. The shoulder portion 124 is formed between a radially inward cam surface 126 and a radially outward surface 128. Thus, as the cam 118 rotates clockwise with leg portion 38, the shoulder 112 is also rotated clockwise by spring 86 until the surface 122 and shoulder 124 engage, thereafter maintaining the link member 36 in the position shown in FIG. 4. From the partially open position shown in FIG. 4, link member 36 and carriage 46 move to the left along track 62, thus further opening the door.

When the door is moved from the open position to a closed position, the carriage 46, link member 36 and door edge 28 move along the body to the position shown in FIG. 4. Thereafter, a surface 130 of end 92 engages the roller guide 108 which pivots the lever 80 counterclockwise toward the latched position shown in FIG. 2. Once the lever 80 is pivoted counterclockwise to the position shown in FIG. 2, the end surface 122 of lever 80 and shoulder portion 124 are disengaged to permit the link member 36 and leg portion 38 thereof to rotate counterclockwise with respect to the carriage 46. In this manner, the door 24 is moved slightly forward and laterally inward to a flush position with respect to the body.

It should be noted that the subject hinge and latch assembly is utilized to support the rearward edge of the door and to guide it in its lateral and rearward motion. There are also separate door-closed latching devices as are presently found on the 1977 Chevrolet van-type vehicle. They maintain the door in its closed position. The latching devices are released when the handle portion 32 of the door is actuated. Thereafter, the subject hinge and latch assembly operates to guide the opening and closing movements of the door.

Although one embodiment of the subject invention has been illustrated, modifications are contemplated which would not change the basic structure and functional characteristics and thus not fall outside the scope of the following claims which define the invention.

What is claimed is as follows:

1. An improved hinge and latch mechanism for supporting one edge of a vehicle sliding door to initially move the one edge laterally from a vehicle body during an opening operation and subsequently to guide movement of the one edge in a longitudinal direction along the vehicle body comprising: a link member having spaced end portions, one end portion of which is attached to the one edge of the door in a manner permitting pivotal movement about a generally vertical axis therebetween, the other end portion of the link member being operably attached to the vehicle, a track supported by the vehicle and extending in a general horizontal direction longitudinally with respect to the vehicle, a carriage member movable along said track with means operably engaging the other end portion of said link member to permit a pivotal movement therebetween about a substantially vertical axis, whereby the spaced end portions of said link member are aligned in substantial longitudinal orientation with respect to the vehicle when the door is closed, but are movable with respect to one another by pivoting of the link member into a laterally outward transverse orientation with respect to the vehicle after the door begins its opening movement, a latch mechanism associated with said link member for locking said link member in its transverse orientation subsequent to initial door opening movement, thereby permitting the link member and carriage to thereafter follow the track to the door's fully open position, said latch mechanism including a striker supported at one end of said track adjacent the one end of said door when in a closed position, a latch lever pivotally attached at its midpoint to the carriage about an axis parallel to the axis of the end portion, one end of said lever engageable with said striker when the door is closed, latch lever actuating means attached to the other end portion of the link member for rotation therewith and for controlling pivotal movement of said latch lever between an engaged latch position with said striker and a released unengaged position, said actuating means having a shoulder-forming portion thereon, an opposite end of said latch lever engaging said actuating means to maintain said latch lever and its one end into engagement with the striker when the door is closed and to move the one end into a released position as the link member rotates, the shoulder-forming portion engaging the opposite end surface after a predetermined rotation of the link member to its transverse orientation, thereafter locking the link member 16 in its transverse orientation during sliding movement of the door with respect to the vehicle body as produced by movement of the carriage along the track, and guide means adjacent said striker positioned to engage the one end of said latch lever, thereby pivoting the latch lever so as to free the opposite end from the shoulder-forming portion as the door moves toward its closed position and thereafter permitting the link member to pivot from its transverse position to its longitudinally oriented position.

2. An improved hinge and latch mechanism for supporting one edge of a vehicle sliding door to initially move the one edge laterally from a vehicle body during an opening operation and subsequently to guide movement of the one edge in a longitudinal direction along the vehicle body comprising: a link member having spaced end portions, one end portion of which is attached to the one edge of the door in a manner permitting pivotal movement about a generally vertical axis therebetween, the other end portion of the link member being operably attached to the vehicle, a track supported by the vehicle and extending in a general horizontal direction longitudinally with respect to the vehicle, a carriage member movable along said track with means operably engaging the other end portion of said link member to permit pivotal movement therebetween about a substantially vertical axis, whereby the spaced end portions of said link member are aligned in substantial longitudinal orientation with respect to the vehicle when the door is closed, but are movable with respect to one another by pivoting of the link member into a laterally outward transverse orientation with respect to the vehicle after the door begins its opening movement, a latch mechanism associated with said link member for locking said link member in its transverse orientation subsequent to intial door opening movement, thereby permitting the link member and carriage to thereafter follow the track to the door's fully open position, said latch mechanism including a striker supported at one end of said track adjacent the one end of said door when in a closed position, a lever pivotally attached at its midpoint to the carriage about an axis parallel to the axis of the end portion, one end of said lever formed into a hooked configuration to engage said striker when the door is closed, a cam member attached to the other end portion of the link member for rotation therewith and having a radially outward arcuate portion and a radially inward arcuate portion, each separated by an abrupt offset shoulder-forming portion, a second end of said lever engaging said arcuate edge portion of said cam, whereby said radially outward arcuate portion maintains said lever and its hooked configuration into engagement with the striker when the door is closed and the radially inward arcuate portion and shoulder-forming portion of the cam engages the second end of the lever after the link member is pivoted to its transverse position, thereby maintaining the link member in its transverse orientation during subsequent sliding movement of the door, which is accomplished by movement of the carriage along the track, and means adjacent said striker to engage the one end of said lever, pivoting the lever so as to free the second end from the shoulder-forming portion of the cam as the door is moved to a closed position, thereby permitting the link member to pivot from its transverse position to its longitudinally oriented position.

* * * * *

UNITED STATES PATENT AND TRADEMARK OFFICE

CERTIFICATE OF CORRECTION

PATENT NO. : 4,110,934

DATED : September 5, 1978

INVENTOR(S) : John F. Zens

It is certified that error appears in the above-identified patent and that said Letters Patent are hereby corrected as shown below:

Claim 2, Column 6, line 26, "accomplished" should be -- accompanied --.

Signed and Sealed this

*Twenty-fourth* Day of *April 1979*

[SEAL]

*Attest:*

RUTH C. MASON
*Attesting Officer*

DONALD W. BANNER
*Commissioner of Patents and Trademarks*